US005910056A

United States Patent [19]

Nagamoto et al.

[11] Patent Number: 5,910,056

[45] Date of Patent: Jun. 8, 1999

[54] GOLF CLUB

[75] Inventors: Itsushi Nagamoto; Atsushi Tsuchida, both of Hamamatsu, Japan

[73] Assignee: Yamaha Corporation, Shizuoka, Japan

[21] Appl. No.: 09/120,106

[22] Filed: Jul. 21, 1998

[30] Foreign Application Priority Data

Sep. 10, 1997 [JP] Japan ..... 9-245226

[51] Int. Cl.[6] ..... A63B 53/02

[52] U.S. Cl. ..... 473/305; 473/305

[58] Field of Search ..... 473/305, 306, 473/308, 309, 310, 316, 313; 273/80.2, 80.3, 167 E, 167 F; 403/268

[56] References Cited

U.S. PATENT DOCUMENTS 5,324,033 6/1994 Fenton, Jr. ..... 473/305

5,647,807 7/1997 Nagamoto ..... 473/305

5,772,525 6/1998 Klein ..... 473/300

5,820,482 10/1998 Sessions ..... 473/305

*Primary Examiner*—Kien T. Nguyen

*Attorney, Agent, or Firm*—Koda & Androlia

[57] ABSTRACT

A golf club with a ferrule mounted in the opening end of a club shaft insertion hole formed in the hosel of a club head. A plurality of recessed grooves are formed in the inner circumferential surface of the through-hole of the ferrule in which the tip-end of the club shaft is press-fitted, and these recessed grooves are filled and coated with a bonding agent so that the ferrule is securely attached to the tip-end of the club shaft.

6 Claims, 2 Drawing Sheets

GOLF CLUB

BACKGROUND OF THE INVENTION

1. Field of the Invention

The present invention relates to a golf club and more particularly to an improvement in the structure for attaching the ferrule to the club shaft.

2. Prior Art

In golf clubs such as irons and woods as shown in FIG. 3, the tip-end e of the club shaft d is inserted and bonded via a bonding agent P in a club shaft insertion hole c formed in the hosel b of the club head a. A ferrule member f made of a plastic such as Celluloid (trademark) is installed in the opening end of the club shaft insertion hole c which constitutes the boundary base part of the joint area between the hosel b and the tip-end e of the club shaft d.

Due to the use of the ferrule member f, the golf clubs can prevent the local concentration of stress that is caused by the shock of hitting the ball in the boundary base part in the joint area between the hosel b and the tip-end e of the club shaft d. The ferrule member f can also enhance a cosmetic effect in terms of the external appearance of the golf club.

When the ferrule member f is mounted in the joint area between the hosel b of the club head a and the tip-end e of the club shaft d, the ferrule member f is first fitted in the opening end of the club shaft insertion hole c of the hosel b, and then the tip-end e of the club shaft d is pressure-inserted into the through-hole g. The tip-end e of the club shaft d has an outer diameter that is 0.1 to 0.5 mm greater than the hole diameter of the through-hole g of the ferrule member f so as to obtain a tight fitting between the two.

In other words, the club shaft d is forcibly inserted into the ferrule member f and the ferrule member f is retained on the club shaft d by the pressing force that is obtained from the contraction of the ferrule member f. Thus, the ferrule member f is retained on the club shaft d by means of the so-called "caulking." Accordingly, as shown in FIG. 4, the ferrule member f would slip out of the club shaft insertion hole c of the hosel b and slide away from the hosel b in the axial direction of the club shaft d as indicated by arrow X as a result of the shock of striking the ball during long-term use of the golf club. As a result of such "floating" of the ferrule member f, a local stress concentration occurs in the boundary base part of the joint area between the hosel b and the club shaft d; and, the club shaft d easily breaks.

SUMMARY OF THE INVENTION

Accordingly, the object of the present invention is to provide a golf club in which "floating" of the ferrule member is prevented so that the club shaft is prevented from breaking.

The above object of the present invention is accomplished by a unique structure for a golf club in which the tip-end of a club shaft is inserted and bonded via a bonding agent in a club shaft insertion hole formed in the hosel of a club head, and a ferrule member which has a through-hole through which the tip-end of the club shaft is passed in a press-fitted state is attached in the opening end of the club shaft insertion hole which constitutes the boundary base part of the joint area between the hosel and the tip-end of the club shaft, and the golf club is characterized in that a plurality of recessed grooves are formed in the inner circumferential surface of the through-hole of the ferrule member, and these recessed grooves are filled and coated with a bonding agent, so that the ferrule member is securely retained on the club shaft.

In the structure above, the recessed grooves may have different configurations including helical, lattice-form, and longitudinal-stripe-form configurations.

DETAILED DESCRIPTION OF THE INVENTION

Figure 1:
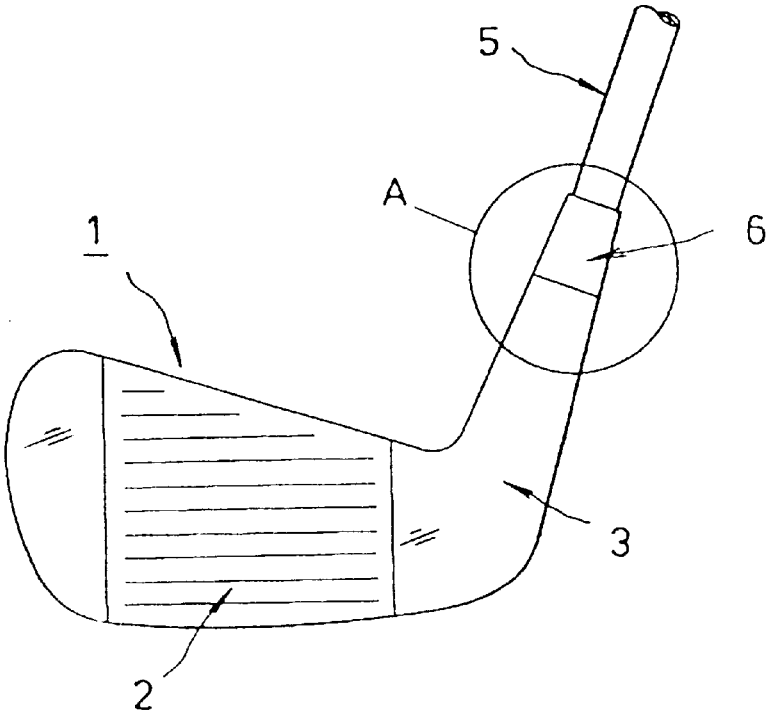
FIG. 1 is an explanatory diagram which illustrates one embodiment of the golf club according to the present invention.
Figure 2:
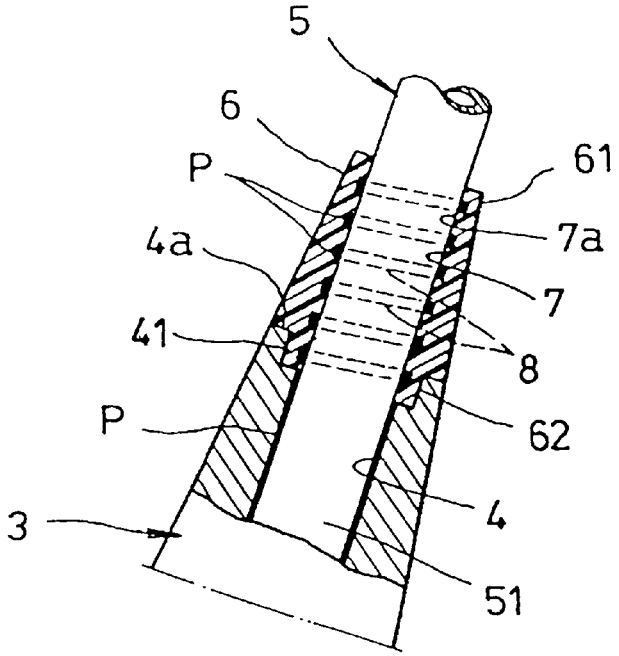
FIG. 2 is a partial enlarged sectional view of the joint area between the hosel of the club head and the club shaft in the area marked "A" in FIG. 1.
Figure 3:
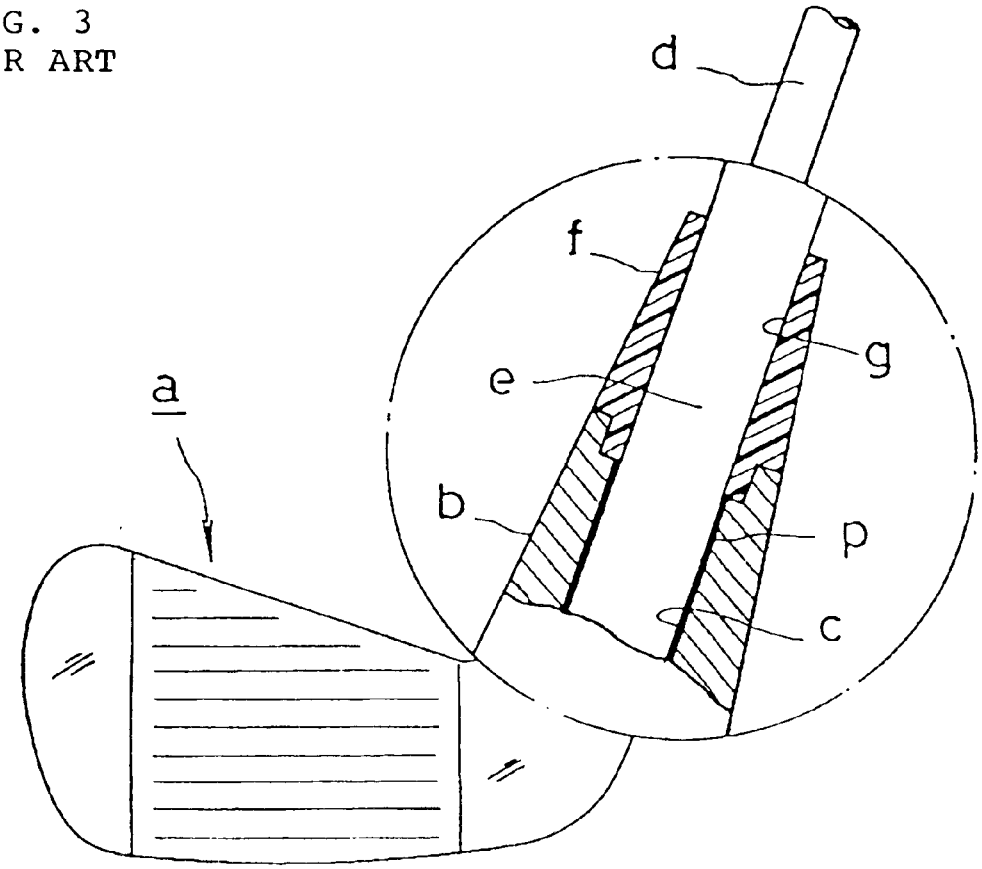
FIG. 3 PRIOR ART
FIG. 3 is an explanatory diagram in a partial enlarged sectional illustration, showing the essential sections of the joint area between the hosel of the club head and the club shaft in a conventional golf club.
Figure 4:
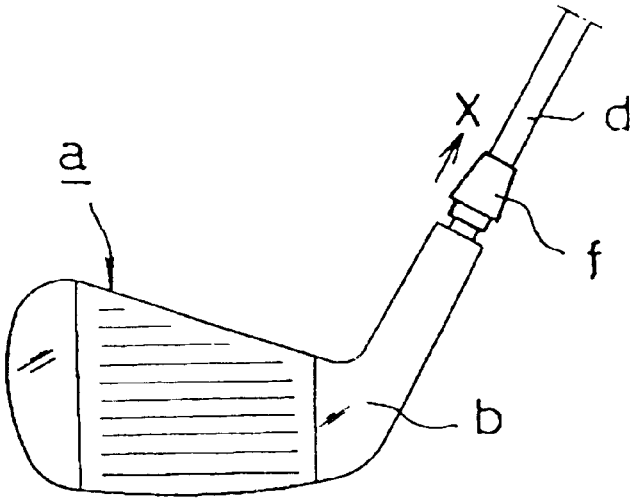
FIG. 4 PRIOR ART
FIG. 4 illustrates a ferrule member "floating" on the club shaft.

A typical embodiment of the present invention will be described in detail below with reference to FIGS. 1 and 2 which show a golf club with an iron club head.

The club head 1 comprises a ball striking part 2 and a hosel 3 which are formed as an integral unit from, for instance, titanium or a titanium alloy. As best seen from FIG. 2, a club shaft insertion hole 4 is formed in the hosel 3 of the club head 1, and a tip-end 51 of a club shaft 5 made of, for instance, a carbon-fiber-reinforced plastic is inserted and bonded via a bonding agent P in the club shaft insertion hole 4.

A ferrule member 6 that consists of, for instance, a plastic such as Celluloid (trademark) is mounted via a bonding agent P in the opening end 4*a* of the club shaft insertion hole 4, which constitutes the boundary base part of the joint area between the hosel 3 of the club head 1 and the tip-end 51 of the club shaft 5. The ferrule member 6 comprises a head part 61 that has, for instance, a truncated cone shape and a body part 62 that has, for instance, a cylindrical shape; and in addition, the ferrule member 6 is formed therein with a through-hole 7 that extends in the axial direction. The body part 62 of the ferrule member 6 is press-fitted in an annular groove 41 which is formed as a step in the opening end 4*a* of the club shaft insertion hole 4 of the hosel 3.

The through-hole 7 formed in the ferrule member 6 has a hole diameter which is 0.1 to 0.5 mm smaller than the outer diameter of the tip-end 51 of the club shaft 5, so that the tip-end 51 is passed through the through-hole 7 in a press-fitted state. Furthermore, a plurality of recessed grooves 8 are formed in the inner circumferential surface 7*a* upon which a bonding agent P is applied, and the recessed grooves 8 are filled and coated with the bonding agent P. In this embodiment, the plurality of recessed grooves 8 is obtained by a groove that is formed in the inner circumferential surface 7*a* with a helical configuration. The ferrule member 6 is bonded to the tip-end 51 of the club shaft 5 with the bonding agent P filled in and coated on the recessed grooves 8.

More specifically, when the ferrule member 6 is attached to the hosel 3 of the club head 1 together with the club shaft 5, the body part 62 of the ferrule member 6 is first press-fitted in the annular groove 41 that is formed as a step in the opening end 4*a* of the club shaft insertion hole 4 of the hosel 3, and a bonding agent P is applied to the respective inner circumferential surfaces of the club shaft insertion hole 4 of the hosel 3 and the through-hole 7 of the ferrule member 6, and then, the tip-end 51 of the club shaft 5 is inserted into the club shaft insertion hole 4 of the hosel 3 while being press-fitted in the through-hole 7 of the ferrule member 6.

In the above, the ferrule member 6 is mounted to the hosel 3 of the club head 1 at the same time that the club shaft 5 is attached to the hosel 3. However, it is also possible that a bonding agent P is first applied to the inner circumferential surface 7*a* (including the recessed groove 8) of the through-hole 7 of the ferrule member 6, the ferrule member 6 is attached to the tip-end 51 of the club shaft 5 by press-fitting the tip-end 51 into the ferrule member 6 that is applied with the bonding agent P, and then the tip-end 51 of the club shaft 5 is inserted into the club shaft insertion hole 4 of the hosel 3.

As seen from the above, in the present invention, a plurality of recessed grooves 8 are formed in the inner circumferential surface 7*a* of the through-hole 7 of the ferrule member 6 through which the tip-end 51 of the club shaft 5 is passed in a press-fitting fashion, and these recessed grooves 8 are filled and coated with a bonding agent P so that the ferrule member 6 is bonded to the tip-end 51 of the club shaft 5. Accordingly, the ferrule member 6 is assuredly bonded and fastened to the club shaft 5 by the pressing force (caulking) of the ferrule member 6 against the club shaft 5 and the anchoring effect provided by the bonding agent P.

The above description is made with reference to an iron club; however, the present invention is applicable to a wood golf club as well.

The recessed grooves 8 formed in the inner circumferential surface 7*a* of the through-hole 7 of the ferrule member 6 in the above embodiment are obtained by a helical configuration groove; however, the effect of the present invention can also be sufficiently manifested by forming the recessed grooves 8 in a lattice-form configuration grooves or a longitudinal-stripe-form configuration grooves oriented in the axial direction of the club shaft 5.

As is clear from the above description, in the present invention for a golf club, the tip-end of a club shaft is inserted and bonded via a bonding agent in a club shaft insertion hole of the hosel of a club head, and a ferrule member which has a through-hole through which the tip-end of the club shaft is passed in a press-fitted state is mounted in the opening end of the club shaft insertion hole. A plurality of recessed grooves are formed in the inner circumferential surface of the through-hole of the ferrule member, and these recessed grooves are filled and coated with a bonding agent so that the ferrule member is bonded to the tip-end of the club shaft. Accordingly, the ferrule member 6 is firmly bonded and fastened to the club shaft 5 by way of the multiplied effect obtained by the pressing force (caulking) of the ferrule member 6 against the club shaft 5 and the anchoring effect of the bonding agent P.

As a result, conventionally encountered "floating" of the ferrule member being separated from the hosel and pushed upward on the club shaft can be prevented, and breaking of the club shaft can be avoided.

We claim:

1. A golf club wherein:

a tip-end of a club shaft is inserted and bonded via a bonding agent in a club shaft insertion hole formed in a hosel of a club head, and a ferrule member which has a through-hole through which said tip-end of said club shaft is passed in a press-fitted state is mounted in an opening end of said club shaft insertion hole which constitutes a boundary base part of a joint area between said hosel and said tip-end of said club shaft, said golf club being characterized in that a plurality of recessed grooves are formed in an inner circumferential surface of said through-hole of said ferrule member, and said recessed grooves are filled and coated with a bonding agent so that said ferrule member is bonded to said tip-end of said club shaft.

2. A golf club according to claim 1, wherein said recessed grooves formed in said inner circumferential surface of said through-hole of said ferrule member is obtained by a helical groove.

3. A golf club according to claim 1, wherein said recessed grooves formed in said inner circumferential surface of said through-hole of said ferrule member have a lattice-form configuration.

4. A golf club according to claim 1, wherein said recessed grooves formed in said inner circumferential surface of said through-hole of said ferrule member have a longitudinal-stripe-form configuration.

5. A golf club comprising:

a club head having a hosel that is formed with a club shaft insertion hole;

a ferrule member, a part of which being mounted in said club shaft insertion hole of said club head, said ferrule member having a through-hole therein and a recessed groove which is formed in an inner circumferential surface of said through-hole and applied with a bonding agent; and a club shaft with a tip-end thereof inserted into said through-hole of said ferrule member and further into said club shaft insertion hole of said club head.

6. A golf club according to claim 5, wherein said recessed groove is in a helical configuration formed in said inner circumferential surface of said through-hole.

* * * * *